US010384262B2

(12) United States Patent
Itamura et al.

(10) Patent No.: US 10,384,262 B2
(45) Date of Patent: Aug. 20, 2019

(54) DIE-CASTING APPARATUS, DIE-CASTING METHOD, AND DIECAST ARTICLE

(71) Applicant: TOHOKU UNIVERSITY, Miyagi (JP)

(72) Inventors: Masayuki Itamura, Miyagi (JP); Kouichi Anzai, Miyagi (JP)

(73) Assignee: TOHOKU UNIVERSITY, Miyagi (JP)

( * ) Notice: Subject to any disclaimer, the term of this patent is extended or adjusted under 35 U.S.C. 154(b) by 95 days.

(21) Appl. No.: 14/684,860

(22) Filed: Apr. 13, 2015

(65) Prior Publication Data

US 2016/0250684 A1 Sep. 1, 2016

Related U.S. Application Data

(62) Division of application No. 14/345,531, filed as application No. PCT/JP2012/073851 on Sep. 18, 2012, now Pat. No. 9,038,705.

(51) Int. Cl.
*B22D 17/00* (2006.01)
*B22D 21/04* (2006.01)
(Continued)

(52) U.S. Cl.
CPC ..... *B22D 25/02* (2013.01); *B22D 17/002* (2013.01); *B22D 17/007* (2013.01); *B22D 17/10* (2013.01);
(Continued)

(58) Field of Classification Search
CPC .. B22D 17/002; B22D 17/007; B22D 21/007; B22D 15/02; C22C 21/02
See application file for complete search history.

(56) References Cited

U.S. PATENT DOCUMENTS 5,360,333 A 11/1994 Schmidt
5,394,931 A * 3/1995 Shiina ..... B22D 17/007 164/113
(Continued)

FOREIGN PATENT DOCUMENTS

JP 06-190871 7/1994
JP 07-252567 10/1995
(Continued)

OTHER PUBLICATIONS

Davis, J.R. "Aluminum and Aluminum Alloys", ASM International, 1993, p. 97.*
(Continued)

*Primary Examiner* — George Wyszomierski
*Assistant Examiner* — Janell C Morillo
(74) *Attorney, Agent, or Firm* — Young & Thompson

(57) ABSTRACT

A die casting method and apparatus are provided, thereby making it possible to produce a thin diecast product that has hitherto been considered impossible to realize, and a diecast product is also provided. A semi-solidified metallic material is formed having particles in solid phase of a particle size less than 30 μm, and is thereupon injected into a die. A die casting machine has a sleeve into which a melt of metallic material is poured, and the semi-solidifying material there when it has a certain proportion of solid phase reached is injected into the die with a plunger to which pressure is applied. The melt of metallic material is poured into the sleeve so that the material occupies inside the sleeve at a proportion in vertical cross-sectional area of 30% or less. The particle size in this semi-solid material is held unvaried in a product as diecast.

6 Claims, 13 Drawing Sheets

Relation between Injection Time Lag and Crystalline Particle Size (Sleeve Filling Ratio: 20 %)

(51) Int. Cl.

| | |
|---|---|
| ***B22D 25/02*** | (2006.01) |
| ***B22D 17/22*** | (2006.01) |
| ***B22D 17/20*** | (2006.01) |
| ***B22D 17/30*** | (2006.01) |
| ***B22D 17/10*** | (2006.01) |
| ***B22D 21/00*** | (2006.01) |

(52) U.S. Cl.

CPC ..... *B22D 17/20* (2013.01); *B22D 17/203* (2013.01); *B22D 17/22* (2013.01); *B22D 17/2236* (2013.01); *B22D 17/30* (2013.01); *B22D 21/007* (2013.01); *Y10S 164/90* (2013.01)

(56) References Cited

U.S. PATENT DOCUMENTS

| | | | | |
|---|---|---|---|---|
| 5,849,115 | A | 12/1998 | Shiina et al. | |
| 5,925,199 | A * | 7/1999 | Shiina | B22D 17/007 148/538 |
| 5,979,534 | A | 11/1999 | Shibata et al. | |
| 2003/0037900 | A1 | 2/2003 | Winterbottom et al. | |
| 2004/0216857 | A1 | 11/2004 | Saha et al. | |
| 2005/0000604 | A1 * | 1/2005 | Kawahara | C22C 21/06 148/440 |
| 2009/0095434 | A1 | 4/2009 | Kikuchi et al. | |

FOREIGN PATENT DOCUMENTS

| | | |
|---|---|---|
| JP | 07-316709 | 12/1995 |
| JP | 8-134577 | 5/1996 |
| JP | 08-197216 | 8/1996 |
| JP | 9-256127 | 9/1997 |
| JP | 11-226723 | 8/1999 |
| JP | 2000-015429 | 1/2000 |
| JP | 2000-052019 | 2/2000 |
| JP | 2000-334554 | 12/2000 |
| JP | 2007-152435 | 6/2007 |
| JP | 2010-092613 | 4/2010 |
| JP | 2011-147955 | 8/2011 |

OTHER PUBLICATIONS

Davis, J. R. "Aluminum and Aluminum Alloys", ASM International, 1993, p. 101-103.*

International Search Report, PCT/JP2012/073851, dated Oct. 30, 2012.

* cited by examiner

Fig. 1

| Process Step | Outline View |
|---|---|
| ① Die clamping completed | 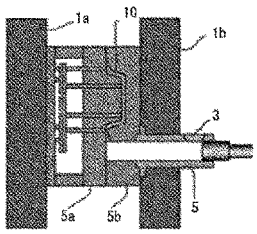  |
| ② Pouring into slleve | 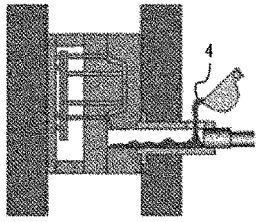  Optimized Semi-Solid Casting Conditions<br>① Pouring temperature<br>② Sleeve temperature<br>③ Sleeve filling factor<br>④ Injection time lag |
| ③ Injection completed | 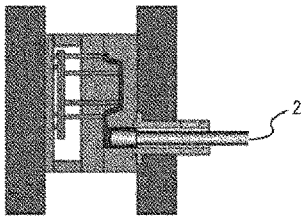  |
| ④ Die opening<br>Pushing out a product<br>Protrusion after injection | 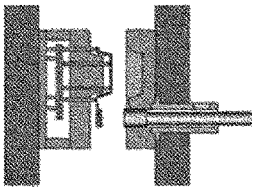 |

Process Steps of Semi-Solid Die Casting in Sleeve Process

Filling Proportion of Melt in a Space of Sleeve

Relation between Sleeve Filling Factor and Modulus (V/S)

Fig. 7
Influence of Pouring Temperature and Sleeve Filling Factor on Temperature in sleeve
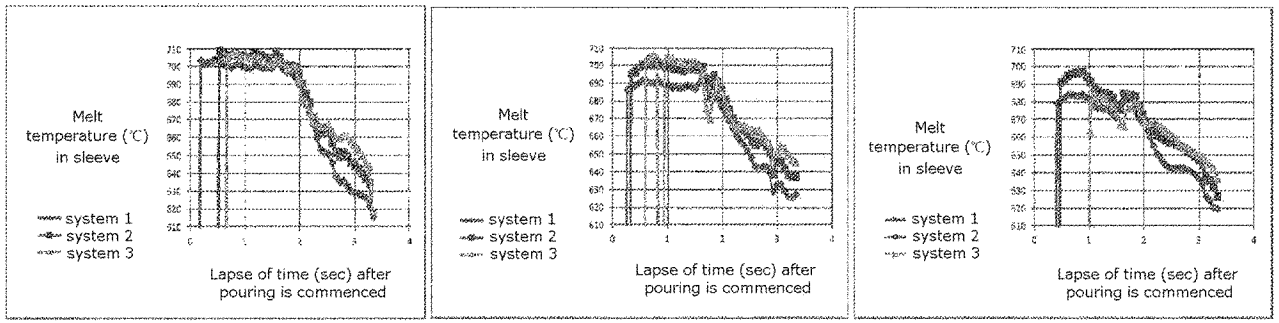
at 136 mm from plunger tip at 256 mm from plunger tip at 376 mm from plunger tip
Pouring temperature of 710 ℃; Sleeve filling factor of 35 %
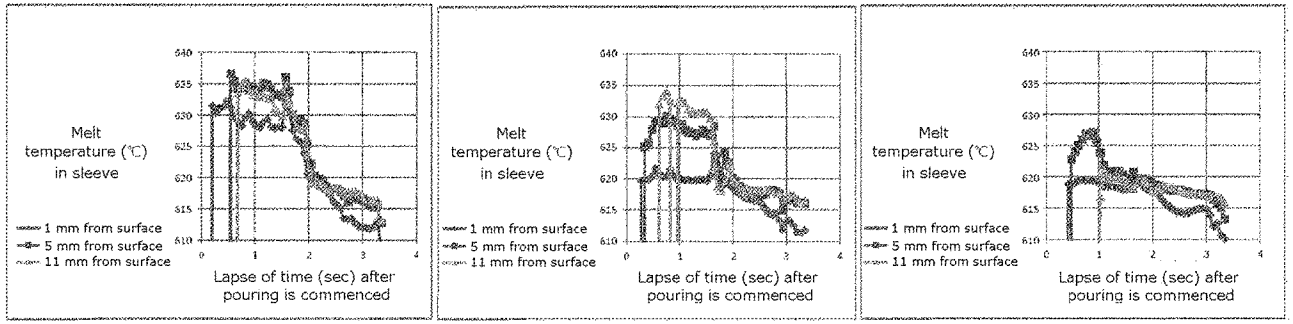
at 136 mm from plunger tip at 256 mm from plunger tip at 376 mm from plunger tip
Pouring temperaturte of 640 ℃; Sleeve filling factor of 35 %

Influence of Pouring Temperatureand Sleeve Filling Factor on Temperature in Sleeve at 136 mm from plunger tip
at 256 mm from plunger tip
at 376 mm from plunger tip Pouring temperature of 710 ℃; Sleeve filling factor of 35 %

Pouring temperature of 640 ℃; Sleeve filling factor of 18 %

Relation between Sleeve Filling Factor and
Microfine Metallographic Structure
(injection time: 5 seconds)

Results of Measurement of Melt Temperature in Sleeve

Diagram for Relation between Rate of Cooling and Crystalline Particle Size

Fig. 12
Relation between Injection Time Lag and Microfine Spheroidal Structure
(sleeve filling factor: 25 %)
| Injection time lag | Metallographic observation magnification: x 450 | Metallographic observation magnification: x 2000 |
|---|---|---|
| Injection after 0 sec from pouring | 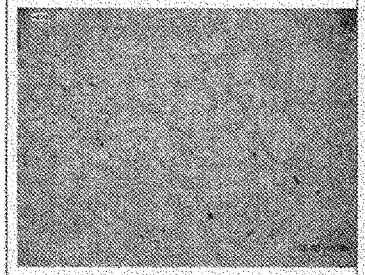 | 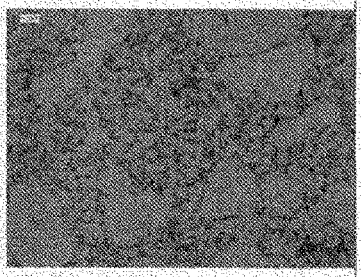 |
| Injection after 3 sec from pouring | 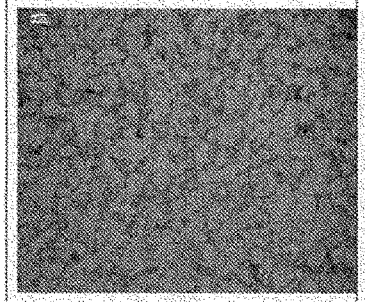 | 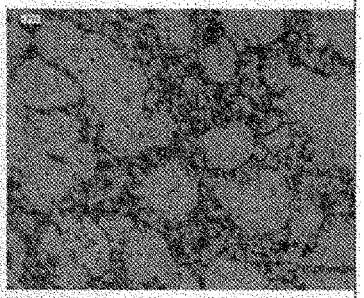 |
| Injection after 5 sec from pouring | 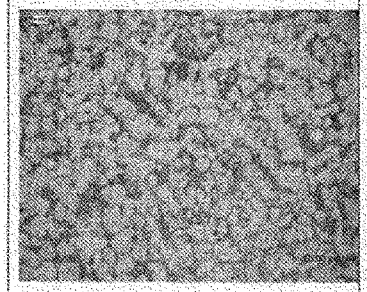 | 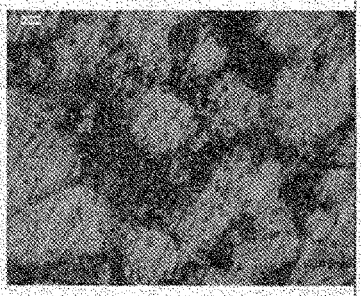 |

Relation between Injection Time Lag and Crystalline Particle Size
(sleeve filling factor: 25 %)

DIE-CASTING APPARATUS, DIE-CASTING METHOD, AND DIECAST ARTICLE

This application is a division of U.S. application Ser. No. 14/345,531, filed Mar. 18, 2014, now U.S. Pat. No. 9,038,705, filed as application No. PCT/JP2012/073851 on Sep. 18, 2012.

TECHNICAL FIELD

The present invention relates to a die casting method and a die casting apparatus as well as a diecast product.

BACKGROUND ART

Die casting is a technology in which a melt of metallic material (non-ferrous metal such as zinc, aluminum or magnesium or an alloy thereof) is injected under elevated pressure into a die or mold mounted in a die casting machine to allow the metallic material to solidify therein, the solidified metallic material being thereafter taken out of the die. Die casting is excellently characterized in that it is productive and products diecast are high in dimensional accuracy, superior in strength and aesthetically fine in appearance, requiring mechanical machining the least.

Semi-solid die casting techniques have further been developed in which instead of injecting a melt of metallic material into a die, a semi-solid material (semi-solid slurry) formed and prepared separately is received in a sleeve disposed in front of the die and the semi-solid slurry is injected into the die by a plunger.

To wit, as recent techniques for yielding quality cast products, semi-solid die casting techniques (thixocasting or semi-molten casting and rheocasting or semi-solidified casting) are accepting attention.

Rheocasting is a method of cooling an alloy from its liquid state while it is being agitated to grow primary crystal in the form of particles, and molding when a certain rate of solidification is reached, and is also called semi-solidified casting. As for thixocasting which is also called semi-molten casting, an alloy molten is once solidified while it is being agitated to form a billet which when cast is heated again to form a body in solid and liquid coexisting state, the body being then molded. Thixocasting has not only a problem that such billets are expensive which are to be controlled of structure and are special but also has those in respect of energy saving and recycling in that billets are to be re-molten into a semi-molten slurry to be cast. One that is once cast cannot be re-used upon re-melting. Presently, rheocasting is mainstream.

As one of rheocasting processes which are in a stage of being developed into commercial use, there is a NRC (New Rheo-Casting) process developed by Ube Industries, Ltd with proven results of an aluminum alloy for cast iron in volume production of undercarriage parts and brake calipers of automobiles.

The NCR process is a process in which a low-temperature melt while it is not agitated is poured with a slurry cap and after crystallization of a given amount of solid phase, the slurry in solid and liquid coexisting state is put into an injection sleeve for injection filling.

The NRC process, however, requires time in forming the semi-solidified slurry, necessitates large and costly equipment and has a limit in micronizing a spherical crystal due to an insufficient number of occurrences of nucleation.

A present inventor has separately developed cup processes such as a process (nano-casting process) in which to form a slurry inexpensively, quickly and simply and to increase the number of occurrences of nucleation, agitation is produced electromagnetically (Patent Document 1), and a self-agitating method (Patent Document 2).

The cup processes are a semi-solid die casting method in which a melt of metallic material is poured into a cup to form a semi-solidified slurry therein, and the semi-solidified slurry is moved into a sleeve, the semi-solidified slurry being thereafter injected or molded into a die.

On the other hand, there is a process in which a melt is poured into a sleeve and semi-solidified into a slurry therein, the semi-solidified slurry in the sleeve being thereafter pushed into a die. This process is called a sleeve process (e.g. Patent Document 3).

The conventional die casting techniques including semi-solid die casting processes, however, has a limitation in thickness, i.e. a limitation in thickness of products that can be made. The limitation in thickness has been described as t=0.6 to 1.0 mm (e.g. http://www.nagas.co.jp/technology/index.html).

Indeed, no diecast product exists having a thickness of less than 0.6 mm.

It can be noted here that Patent Document 4 proposing a technique of making a separator by a semi-solid die casting process, describes in claim 6 that "separator has a plate thickness of 0.4 mm or less in its thinnest area."

The plate thickness mentioned there, however, is that which as described (in paragraph 0032 of Patent Document 4) as "Since the separator is formed with grooves on their both sides, it is the thinnest in an area where the groove on the one side and the groove on the other side are crossed", is in fact a distance in an area where the groove on the one side and the groove on the other side are crossed, and further which as described (in paragraph 0053) as "A flat plate may be molded and be thereafter formed with the grooves by mechanical machining. Further, the flat plate after it is molded is formed with the grooves by stamping", is in fact of a thickness of an area where the grooves are created by machining after die casting and not of a thickness as cast.

In an attempt to micronize a primary crystal α, a technique is proposed in Patent Document 5.

It is a technique in which a melt of metallic material is poured along an inclined plate into a container and a process in which cooling is controlled by the inclined plate cooled for nucleation to form a semi-solid slurry. Attempting, however, to optimize the temperature to which the inclined plate is cooled, the distance of its contact with the melt, the angle of its inclination and the temperature at which the melt is poured, fails to stabilize granulation and to render the process operational. There is the restriction that raising the rate of cooling does not allow increasing the rate of flow of the melt along the cooled inclined plate. The melt if reduced in rate of flow comes to flow while meandering. Because of the difficulty to hold a steady state, it is the present situation that not only does the resulting grain or particle size of primary crystal α vary widely in a range between 100 and 200 μm but also low rate of flow of the melt causes oxidation of its surfaces, leaving the process commercially nonoperational.

PRIOR ART REFERENCE

Patent Reference

Patent Document 1: JP B 3496833
Patent Document 2: JP B 3919810
Patent Document 3: JP A 2004-114154
Patent Document 4: JP A 2010-92613
Patent Document 5: JP A H08-326652

SUMMARY OF THE INVENTION

Problems to be Solved by the Invention

It is an object of the present invention to provide a die casting method and apparatus whereby it is made possible to produce a diecast product having a thickness of 0.5 mm or less and also to provide a diecast product as made by the method.

Means for Solving the Problems

In accordance with the present invention, there is provided a die casting method characterized in that it comprises forming a semi-solid metallic material of a structure having particles in solid phase of a particle size not more than 30 μm, and thereupon injecting the semi-solid metallic material into a die.

Mention is made of aspects of the present invention together with findings acquired in making the invention.

Upon going through research efforts zealously to break through the limitation of thickness, the present inventors have found that as particles of primary crystal α are micronized to reduce from their conventional particle size (50 μmm) further, their flow behavior are changed to as of a viscous fluid flowing without solidifying and with a viscosity depending on a pressure.

It has been found that the change in flow behavior occurs starting from a certain value as its boundary.

And, it has then been observed that a volume even of a thickness of 0.5 mm or less is completely filled up.

With a melt of metallic material injected in its liquid state under pressure, its solidification is instantaneously advanced and its flow is terminated while it is still at a low proportion of solid, which is considered due to dendrites formed to grow at a time, impeding the flow.

In contrast to this, forming a large number of fine primary crystalline particles facilitates development of a supercooling phenomenon whereby in spite of the fact that a temperature is reached at which solidification is essentially to be effected, solidification is retarded from progressing, thereby permitting a flow to be effected with a high pressure applied. To wit, it has been discovered that a flow occurs as of a viscous fluid and that a critical point of 30 μm exists, i.e. starting with this value as a boundary, a behavior as of a viscous fluid is exhibited.

Having a particle size of solid phase not more than 30 μt m ensures development of a viscous fluid, thereby making it possible to make a diecast product having a thickness of 0.5 mm or less.

Further, a particle size in the present semi-solid material is held unvaried in a product as cast.

It should be noted here that the term "particle size of particles" used herein is intended to mean an average value of their longer and shorter diameters.

The invention according to a preferred embodiment of the invention is for a die casting method characterized in that it comprises forming in a sleeve a semi-solid metallic material of a structure having particles of a particle size which is not more than 30 μm and thereupon injecting the said semi-solid metallic material into a die.

The invention according to a particularly preferred embodiment is for a die casting method characterized in that the particle size ranges between 10 μm and 30 μm.

The smaller the particle size, the more remarkable becomes the behavior that the metallic material assumes as of a viscous fluid.

The invention according to a particularly preferred embodiment is for a die casting method wherein the die into which the metallic material being injected flows is provided with a portion where the metallic material being cast is to be of a thickness not more than 0.5 mm.

According to the present invention, with an intended product that is formed with a thick, a thin, a thick, and a thin portion to be successively cast with the material flowing, such a thin portion having a thickness of not more than 0.5 mm and even of 0.1 mm or less can completely be filled up.

The invention according to a particularly preferred embodiment is for a diecast product that is of a structure with particles of a particle size less than 30 μm.

In the sleeve into which pouring is effected, fine particles such as of primary crystal are formed, whose particle size is reflected as it is in a product. As a diecast product as well, it has a metallographic structure reflected, having the fine particle size (not more than 30 μm).

The invention according to a particularly preferred embodiment is for a diecast product which as cast has a portion having a thickness of 0.5 mm or less.

Given a particle size of 30 μm or less and with this particular maximum particle size as a boundary, the semi-solid material as mentioned above will apparently no more be solidified at a temperature at which it is essentially to continue to be solidified but will continue to flow as a realized viscous fluid in the die while receiving a pressure that is of corresponding magnitude. Consequently, it has been found that a portion as thin as not more than 0.5 μm, even 0.1 mm or less, can be filled with the material, making it possible to produce such parts.

The invention according to a particularly preferred embodiment is for a diecast product wherein it is composed of an eutectic alloy.

The invention according to a particularly preferred embodiment is for a diecast product wherein it is composed of an aluminum alloy.

A metal or metallic material of interest in the present invention will not particularly be limited to, though especially a low-melting alloy such as an aluminum alloy is effective. Prescribed by JIS, Al—Si system (ADC1), Al—Si—Mg system (ADC3), Al—Si—Cu system (ADC10, 10Z, ADC12, 12Z, ADC14), Al—Mg system (ADC5, 6) and so forth are conveniently used.

Other than aluminum alloys are likewise effective a magnesium alloy, a zinc alloy and the like.

Another preferred embodiment of the invention is a die casting method wherein a filling factor of the metallic material in the sleeve, a temperature at which a melt of the metallic material is poured into the sleeve, a geometry of the sleeve, a temperature of the sleeve and a rate of cooling the sleeve are suitably set at so as to form the semi-solid metallic material of a structure having particles of a particle size not more than 30 μm in the sleeve.

The term "filling factor" used herein is intended to mean a volume or area proportion: $(A/S)\times100(\%)$ where A is an area in cross section of the melt poured and S is an area in cross section of the sleeve, in a plane perpendicular to a length of the sleeve.

Forming a semi-solid metallic material of a structure having particles of a particle size not more than 30 μm requires achieving a greater supercooling (higher rate of cooling) to create a larger number of sites of nucleation.

Accordingly, varieties of conditions were varied and investigated whereupon it has been found that the filling factor of a melt in a sleeve, the pouring temperature, the sleeve geometry, and the sleeve temperature and cooling rate can be suitably selected to achieve forming a semi-solid metallic material of a structure having particles of a particle size not more than 30 μm.

By reducing the filling factor of the melt in the sleeve, it is possible to take the area of contact between the melt and the sleeve larger.

FIG. 3 shows a relation between a modulus (V/S) and a filling factor of the melt in the sleeve.

The modulus (V/S) of the melt filled in the sleeve increases as the filling factor is increased. To the distance L from the melt surface to the sleeve bottom is essentially proportional the modulus (V/S). Therefore, the higher the filling factor, the larger is the modulus, extending the time of solidification and, in other words, reducing the rate of cooling. To bring nuclei out more, the filling factor is preferably made low.

Also, setting the casting temperature low, the die temperature low and the heat drawing rate high allow increasing the number or rate of occurrences of nucleation.

The points mentioned above are summarized as stated below.

Even at an identical proportion of solid, micronizing the particles in size (not more than 30 μm) shows better fluidity and die cavity filling capability. As one technique to micronize particles in size, mention is made of reducing the sleeve filling factor to be not more than 30%. Thus, it is utilized that setting the sleeve filling factor not more than 30% makes it possible to vary V/S (M) largely and to dramatically accelerate the cooling rate to increase the rate of nucleation. And, additionally controlling the melt temperature in the sleeve allows the metallic material in the form of a semi-solid slurry in which nuclei that have be created, without becoming extinct, are uniformly dispersed colloidally to be injected into a die cavity and thereby to fill the die cavity therewith.

A large amount or high rate of occurrences of nucleation is achieved by controlling the heat drawing rate while or without setting the sleeve filling factor not more than 30%. The heat drawing rate can be controlled by controlling the sleeve process, the sleeve temperature, the cooling rate and so forth. Specifically, data may be found in pretests.

To increase the rate of heat drawing, the sleeve may have its heat capacity increased. To this end, the sleeve may be thicker in thickness. Also, the sleeve temperature may be lowered to increase the rate of heat drawing.

The invention according to a particularly preferred embodiment is for a die casting method characterized in that the melt of metallic material is poured into the sleeve so as to occupy inside the sleeve at the filling factor of not more than 30%.

The invention according to a particularly preferred embodiment is for a die casting method characterized in the melt of metallic material is poured into the sleeve so as to occupy inside the sleeve at the filling factor of not more than 20%.

A variety of melt heat insulating means have been developed for a basic die casting process such that a melt with a degree of superheat of (liquidus+α) can be filled into the cavity.

A melt has its temperature decreased with lapse of time. When the temperature is lowered, the melt cannot be filled into the cavity while holding a degree of superheat of (liquidus+α). Thus, a melt superheated in general to a temperature higher by around 100° C. than the liquidus is poured into a sleeve so that its temperature is not lowered. As a result, a sleeve filling factor exceeding 30 or 40% has become a common sense. Further, it has been a common sense to those skilled in the die casting art to initiate injecting as soon as the melt has been poured into the sleeve and thus before its temperature may be lowered (and thus without a shot time lag).

Thus, sharply departing from the conventional concept in the die casting art, the present invention as mentioned contemplates reducing the sleeve filling factor (preferably to be not more than 30% and more preferably not more than 20%) and this, to micronize particles not more than 30 μm in particle size.

The invention according to a particularly preferred embodiment is for a die casting method wherein the pouring temperature set at is a temperature higher by 0 to 100° C. than a melting point of the metallic material.

In the process of the present invention, the state of a low viscosity is maintained over a long time. Consequently, it is made possible to set the melt temperature at a temperature lower than in the prior art. Lowering the melt temperature makes it possible to reduce entraining or entrapping gases and impurities. A temperature higher by 0 to 50° C. than the melting point is preferred.

The invention according to a particularly preferred embodiment is for a die casting method wherein the pouring temperature set at is a temperature higher by 0 to 50° C. than a melting point of the metallic material.

The invention according to a particularly preferred embodiment is for a die casting method wherein the sleeve is used having a thickness of 0.6 D to 0.8 D.

The invention according to a particularly preferred embodiment is for a die casting method wherein the sleeve is composed of a material which is greater in thermal conductivity than SKD61.

The invention according to a particularly preferred embodiment is for a die casting method wherein the sleeve is composed of a material that is SC46 or a copper alloy.

The invention according to a particularly preferred embodiment is for a die casting method wherein the sleeve temperature set at is a temperature of 100 to 200° C.

The invention according to a particularly preferred embodiment is for a die casting method wherein it comprises applying pressure upon a lapse of no more than 5 seconds after pouring into the sleeve.

The invention according to a particularly preferred embodiment is for a die casting method wherein it comprises applying pressure upon a lapse of no more than 3 seconds after pouring into the sleeve.

The invention according to a particularly preferred embodiment is for a die casting method characterized in that it comprises applying pressure immediately after pouring into the sleeve.

The invention according to a particularly preferred embodiment is for a die casting method wherein the semi-solid metallic material when injected has a proportion of solid phase not less than 50%.

In general, the higher the proportion of solid phase, the lower the fluidity, requiring higher pressure for injection. It may thus be well considered to become harder to fill a portion that is thin in a die.

It has been found, however, that fluidity is ensured of a semi-solid metallic material, even of a high proportion of solid phase, if particles therein are smaller in particle size and, if they are, is more ensured of those of higher proportion of solid phase in filling up a thin portion.

A proportion of solid phase not less than 50% is preferred. It should preferably be not more than 80% which if exceeded would require an excessive pressure for injection.

The invention according to a particularly preferred embodiment is for a die casting method wherein a liquidus line is passed through by the metallic material which is cooled at a rate of cooling not less than 20° C./s.

With a cooling rate of 20° C./s or more, extremely fine particles (having a particle size of 2 to 4 μm) are distributed. The existence of such particles is considered to make it possible to make a diecast product which are thinner without gases entrained and essentially without pores formed.

The invention according to a particularly preferred embodiment is for a diecast product wherein it contains an internal gas at a content not exceeding 1 cc/100 g under an environment of ordinary temperature and pressure.

Another preferred embodiment in accordance with the invention is for a die casting apparatus comprising:

a stationary platen;

a movable platen;

a stationary die member mounted to the stationary platen;

a movable die member mounted to the movable platen;

a sleeve passing through the stationary die member and having one end communicating with a product space formed by the stationary and movable die members; and a pressing means inserted into the sleeve through its other end, the sleeve in a die casting operation having an upper internal space left open and unoccupied, said upper internal space being greater than half its entire internal space.

When application of pressure by a plunger or the like is initiated immediately after a melt has been poured into a sleeve, if the upper side of the sleeve is open and unoccupied, the melt may likely fly out into the open space. In contrast, in the present invention the material that flows with an increased viscosity may unlikely fly out. Since the upper space is opened and unoccupied, the problem that a clearance with the plunger must necessarily be taken is eliminated.

Corresponding to casting conditions, a sleeve of which a material and a geometry (length, diameter, cross-sectional shape, etc.) are varied may suitably be replaced for and used. While SKD61 has conventionally be used exclusively as the sleeve material, a sleeve may be used that is composed of a material larger in heat conductivity than SKD61 to meet with the heat drawing rate and, in turn, the cooling rate that is, e.g. higher. For example, the sleeve may be used that is composed of copper or a copper alloy, ductile iron (e.g. FCD700), SC46, etc. Also, the sleeve may be made in a structure of two layers of which an inner layer is larger in heat conductivity than an outer layer and the outer layer is lager in strength than the inner layer, or vice versa.

Further, the sleeve may be provided inside with a dam, which is mounted to dam in pouring and dismounted when the plunger is operated to apply pressure.

Effects of the Invention

According to the present invention, a wall which have so far been deemed a floating limit is broken through, making it possible for a diecast product having a portion of a thickness of 0.5 mm or less to be made at a dimensional accuracy higher than in the prior art.

BRIEF DESCRIPTION OF THE DRAWINGS

In the Drawings:

FIG. 1 is a flow chart of semi-solid die casting in a sleeve process;

FIG. 7 is a graphical representation showing an influence of a melt temperature and a sleeve filling factor on a temperature in the sleeve;

FIG. 12 presents microphotographs showing a relation between an injection time lag and a microfine spheroidal structure.

DESCRIPTION OF REFERENCE CHARACTERS

Figure 2:
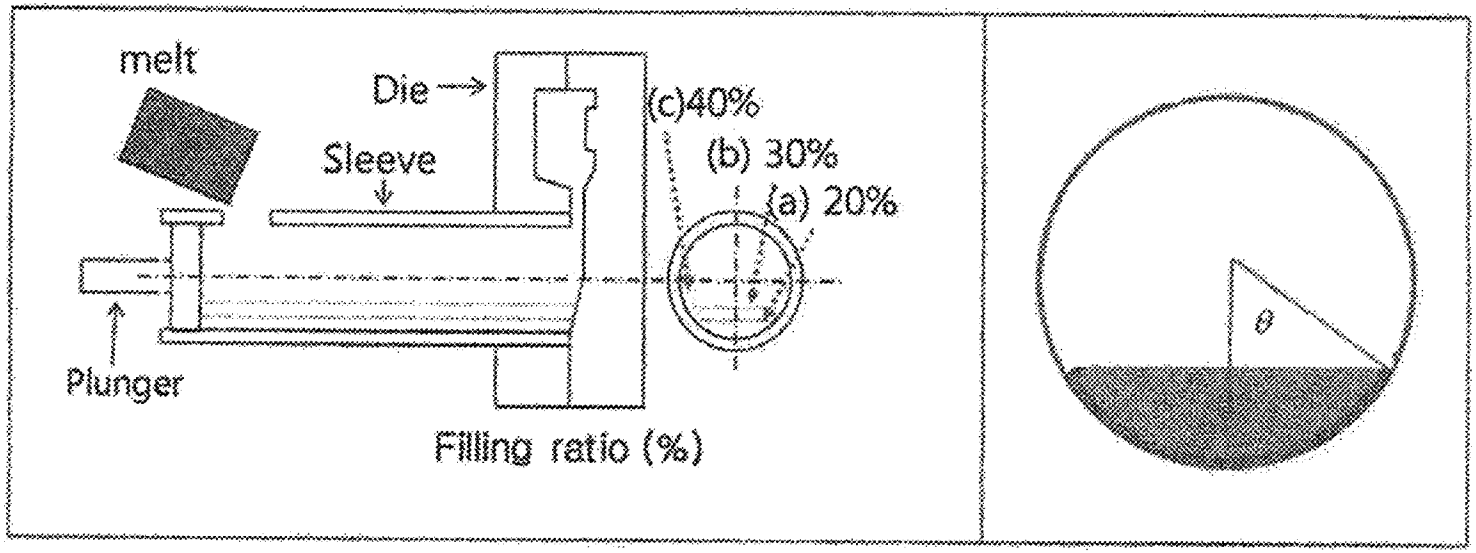
FIG. 2 is a view illustrating a filling factor of a melt poured in a sleeve.

1*a* movable platen
1*b* stationary platen
2 plunger
3 pouring inlet
4 melt
5 sleeve
5*a* movable stationary die member
5*b* stationary movable die member

MODES FOR CARRYING OUT THE INVENTION

The present invention utilizes a sleeve into which a melt of metal or metallic material is poured directly, a technique called a sleeve process.

The sleeve process, without using a cup separately, can be practiced with the basic makeup of a conventional die casting machine.

The makeup is illustrated in FIG. 1.

Referring to FIG. 1, a plunger sleeve 5 is shown that communicates with a cavity 10 formed by and between a stationary die member 5*a* and a movable die member 5*b* which are mounted in a die casting machine. A melt of metallic material 4 poured into the plunger sleeve 5 is injected by a plunger 2 into and to fill the cavity 10. It may be noted though not shown that the plunger 2 is connected with a coupling to an injection cylinder rod mounted in an injection cylinder so that the rate of flow of hydraulically operating oil stored in an accumulator can be adjusted in accordance with the opening of a flow control valve arranged in a hydraulic circuit system of an injection apparatus to adjust the injection speed in an injection process step.

Process steps of semi-solid die casting in the sleeve process are also shown in FIG. 1. As is seen from FIG. 1, the sleeve process eliminates the need for a separate equipment unit for forming a slurry and requires equipment only of a conventional die casting machine in which in the sleeve to crystallize a large number of crystalline nuclei, making it possible to control growth of crystalline particles properly without ceasing them to exist.

In the sleeve process, the stationary and movable die members 5*a* and 5*b* are clamped together (FIG. 1(1)) whereafter the melt 4 is poured through a pouring inlet 3 into the sleeve 5 (FIG. 1(1)). In this step, the pouring temperature, sleeve temperature, sleeve filling factor, etc. are optimally controlled. After pouring, the plunger in an optimum time lag of injection is driven for injection. The state that the injection is completed is shown in FIG. 1(3). After the injection is completed, a product is taken out of the die (FIG. 1(4)). In opening the die to take out the product, the plunger 2 continues to be driven so that its forward end protrudes from the stationary die member 5*a* (from the latter's left side as shown), leaving the product attached to the movable die member 5*b*.

Features of the sleeve process are shown infra compared with NRC, nano casting and cup processes.

(1) Optimum control of the temperature of a melt in the sleeve makes it possible to form a slurry without the need to possess a conventional slurry forming unit; It is possible to inject immediately after pouring the melt in a cup (container); Increasing the number of occurrences of nucleation allows micronization; Cup equipment having a particular specification meeting with a particular casting weight is unnecessary; accessory units for cap cooling, cap cleaning and for application of a parting agent are unneeded.

Relation of Sleeve Factor to Modulus and Proportion of Solid Phase

Attaining a semi-solid material formed with finer size particles than in the prior art is considered to require achieving greater supercooling (a higher rate of cooling) and forming a larger number of nuclei. Accordingly, the melt pouring temperature, sleeve size, sleeve temperature, sleeve filling factor and cooling rate are optimized. Of them, the sleeve filling factor is considered markedly influential. The term "sleeve filling factor" is intended to mean a volume or area proportion: (A/S)×100(%) where as shown in FIG. 2, S is a cross-sectional area of the sleeve in a plane perpendicular to a length of the sleeve and A is a cross-sectional area in the plane of the melt poured into the sleeve. In order to further micronize or make the spheroidal structure finer than in the prior art, it is necessary to achieve greater supercooling (a higher rate of cooling) and creating a larger number of sites of nucleation.

Figure 3:
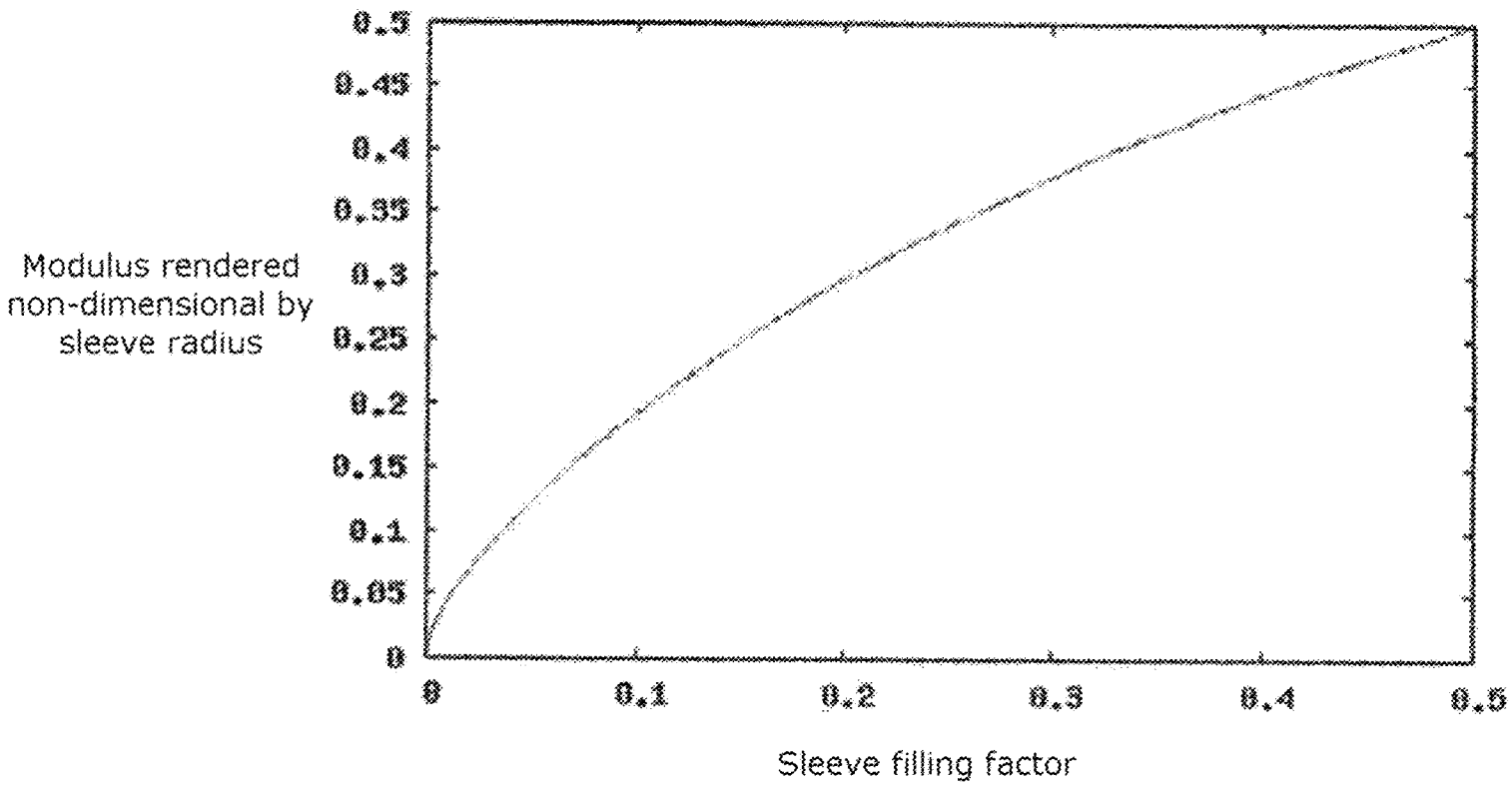
FIG. 3 is a graph illustrating a relation between a sleeve filling factor and a modulus.

The sleeve filling factor can be reduced (increased) to increase the area of contact between the melt and the sleeve. A relation between a sleeve factor and a modulus (V/S) in the sleeve shown in FIG. 3 is as mentioned supra.

The modulus of a melt loaded in the sleeve increases as the sleeve filling factor is increased. The modulus (V/S) is essentially proportional to the distance L from the surface of the melt and the bottom of the sleeve. Thus, as the filling factor is higher, the modulus is greater, extending the time of solidification. To wit, the higher the filling factor, the higher the temperature of the melt immediately after pouring into the sleeve, also reducing the rate of cooling. To achieve a finer spheroidal structure, it is thus important to choose a proper sleeve filling factor.

Embodiment 1

In this embodiment of the invention, a door mirror part shaped as shown in FIG. 1 is produced using a die casting machine of a weight of 125 tons.

The makeup and process steps of the die casting machine are conceptually shown in FIG. 1.

A die casting machine has a stationary platen 1*a* and a movable platen 1*b* disposed as opposed to each other. The stationary and movable platens 1*a* and 1*b* have a stationary and a movable die members 5*a* and 5*b* mounted thereto, respectively. With the stationary and movable die members 5*a* and 5*b* clamped together, the space formed between these die members constitutes a product space.

The stationary platen 1*a* is provided with a sleeve member 4 that is cylindrical. Into the sleeve 4 from its one end is inserted the plunger 2 as a means to press.

On the other hand, the stationary die member 5*a* is formed with an internal space communicating with that of the sleeve member 4. The internal space in the stationary die member 5*a* is in communication via a sprue with the product space. The internal spaces of the sleeve member 4 and the stationary die member 5*a* together constitute a sleeve. In the present invention, a melt poured from a pouring inlet into the sleeve member is designed to flow into the internal space of the stationary die member 5*a* as well.

The sleeve has a length L that is a distance between a face of the stationary die member at its left hand side and a forward end of the plunger.

After clamping of the stationary and movable die members 5*a* and 5*b* is completed, the melt is poured into the sleeve via the pouring inlet 3 (FIG. 1(2)). The filling factor is then controlled.

Upon lapse of a predetermined standby time period after pouring, the plunger is driven, initiating injection under pressure. The state that the injection is completed is shown in FIG. 1(3).

After the injection is completed, a product is taken out of the die. To this end, the die is opened by moving the plunger 2 so that its forward end protrudes slightly from the left face of the stationary die member 5*a* against the product, leaving the product as attached to the movable die member 5*b*.

The sleeve in the die casting machine is sized as follows:

Diameter D of the sleeve: 70 mm

Length L of the sleeve: L=5D (=350 mm)

Temperature of the sleeve: 190° C.

On the other hand, the melt is composed of a material that is:

Melt material: AC4CH having:

Liquidus temperature $T_L$: 610 to 612° C.

Solidus temperature $T_S$: 555° C.

Melt pouring temp.: $T_L$ (liquidus temp.)+40° C. (650° C.)

Weight: 450 g

Note further that into the sleeve the melt is poured at a height of 250 mm from the bottom of the sleeve (the height more than 3.5 times of D).

Heat capacity of the sleeve, heat capacity of the melt being poured and latent heat are computed in advance so that when the sleeve and the melt poured therein reach a thermal equilibrium state, a particular proportion of solid phase selected as desired is achieved. The sleeve size or geometry, melt temperature, sleeve temperature, the rate of pouring the melt and the like are designed so that a heat balance is taken at a desired proportion of solid phase.

When temperatures of the melt and sleeve become equal to each other, heat flow is ceased at a temperature not varied any further (referred to herein as equilibrium temperature). This temperature, $T_{eq}$, is given by an equation stated below Equation (1)

$$T_{eq}=(T_c+\gamma T_m+H'_f f_3)/(1+\gamma) \quad (1)$$

where $T_c$ is an initial temperature of the melt, $T_m$ is an initial temperature of the sleeve, $H'_f$ is a latent heat of solidification divided by specific heat, and $f_s$ is a proportion of solid phase. Also, and $\gamma$ is a heat quantity necessary to raise the temperature of the melt by 1 K, corresponding to a heat quantity necessary to raise the temperature of a cup by 1 K and is given by an equation stated below.

$$\gamma=(\rho_m c_m V_m)/(\rho_c c_c V_c) \quad (2)$$

where $\rho$ is a density, c is a specific heat and V is a volume whereas subscripts c and m identify the melt and sleeve, respectively.

The filling factor of the melt in the sleeve is assumed to be 30%. It is noted here that a filling factor is a volume or area proportion, namely a cross-sectional area of a poured melt relative to a cross sectional area of a receiving sleeve, the cross-sectional areas being taken in a plane perpendicular to a direction in which a pressing means is driven.

Upon a lapse of 4 seconds after the melt is poured, injection under pressure is initiated, i.e. the injection with a shot time lag of 4 seconds.

In injection under a pressure, the top surface of the melt continues to rise gently and without an occurrence of turbulence. A filling factor of 100% is reached there to finish injection into the die.

It should be noted further that in this form of implementation of the invention, the injection into the die is at a proportion of solid phase that is 50%.

Conditions for casting under pressure are shown in a table below in which those on its right column (semi-solid die casting) are in this form of implementation.

TABLE 1

| | Conventional Die Casting (Comparative Ex.) | Semi-solid Die Casting (Embodiment 1) |
|---|---|---|
| Injection Speed | 0.2 m/s | 0.2 m/s |
| Injection Speed | 1.0 m/s | 1.0 m/s |
| Casting Pressure | 60 MPa | 60 MPa |
| Die (fixed) Temp. | 250° C. | 250° C. |
| Die (moved) Temp. | 250° C. | 250° C. |
| Pouring Temp. | 720° C. | 650° C. |
| Sleeve Temp. | | 190° C. |

Figure 4:
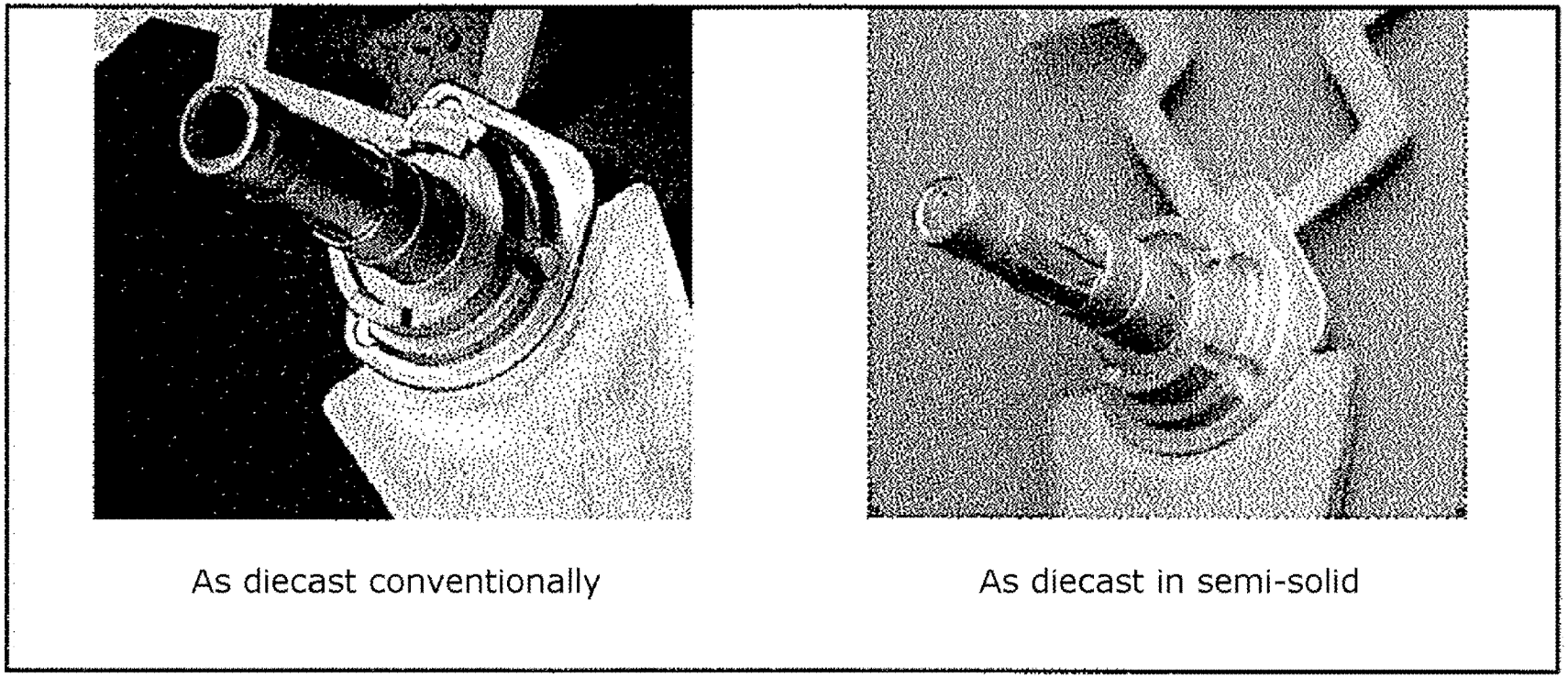
FIG. 4 presents photographs showing appearances of diecast products (for a door mirror part) yielded in Embodiment 1 of the invention and Comparative Example 1, respectively.

A diecast product (door mirror part) made according to the present invention is shown in an outline view in FIG. 4.

In FIG. 4, the diecast product indicated by "diecast in semi-solid" is a door mirror part made according to Embodiment 1. In the door mirror part made according to this embodiment, a cylinder completely has one end filled in the form of a disk. Note that this disk at the one end has a thickness of 0.1 mm. Further, the disk-shaped end portion filled up increases the circularity of the cylindrical portion diecast.

Surface roughness precision and dimensional accuracy of the diecast product are examined, too, yielding results as follows:

Surface roughness precision: 2.1S (acceptance criterion: 6.3S)

Dimensional accuracy: 19/1000 mm (acceptance criterion: 50/1000 mm)

Figure 5:
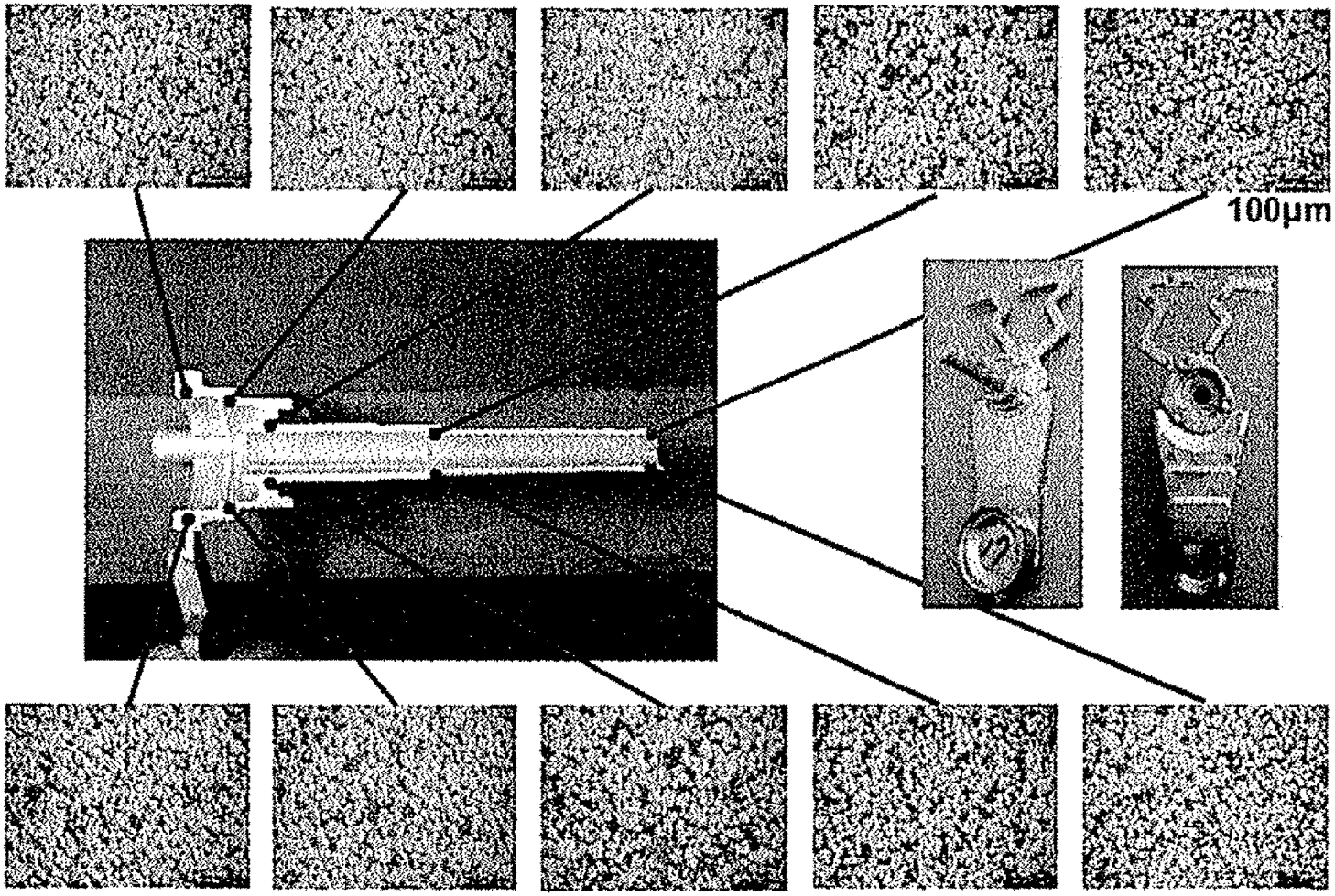
FIG. 5 presents microphotographs each taken of, and showing, a metallographic structure of each of, various portions of the diecast products yielded in Embodiment 1 of the invention.

FIG. 5 diagrammatically shows in section a metallographic structure of each of various portions of the door mirror part diecast according to Embodiment 1.

As can be seen from FIG. 5, a structure is shown having particles of a particle size between 10 and 30 μm in each of the ten cross sections.

Next, an amount of gas contents in a diecast product as cast is examined.

<Gas Analysis>

The diecast product is disposed in a vacuum melting chamber, whose inside is then purged with a high purity argon gas to remove external gases attached to inner walls of the chamber and surfaces of the product. Thereafter, the inside of the chamber is evacuated whereafter the diecast product is molten to form a melt.

The melt is sufficiently agitated and gases are discharged therefrom.

When pressure inside of the vacuum chamber becomes constant after lapse of a given time period, the pressure that becomes unvaried further is measured.

From the pressure and a volume inside of the chamber, an amount of the gases is computed. The amount of gases contained in an aluminum (Al) melt per 100 μg thereof is found to be 0.4 ml at ordinary temperature under normal pressure.

Comparative Example 1

In this comparative example, a material in its liquid state is injected under pressure.

Casting is effected under the conditions shown in the middle column (Conventional Die Casting) of Table 1.

In this comparative example, the melt temperature is higher than in Embodiment 1 and the pressure commences to be applied to the melt immediately after its pouring (i.e. as it is in the liquid state).

During application of the pressure, turbulences (wavy flows leading to splashes) occur in surface regions of the melt.

FIG. 4 shows products in outline views for a door mirror part that result from Embodiment 1 and Comparative Example 1 mentioned above In FIG. 4, it is seen that the door mirror part product indicated by (as diecast conventionally) and made according to Comparative Example 1 has an end of a cylinder left unfilled, the end that should have been formed with a disk of 0.1 mm thick.

The metallographic structure is in the form of dendrites.

This diecast product fails to achieve an acceptance criterion in both surface roughness accuracy and dimensional precision (circularity).

Embodiment 2

In this embodiment of the invention, die casting is effected under the condition same as in Embodiment 1. In die casting, the plunger as a means to press is measured of a speed or rate at which it is advanced and a pressure which it receives from casting.

Figure 6:
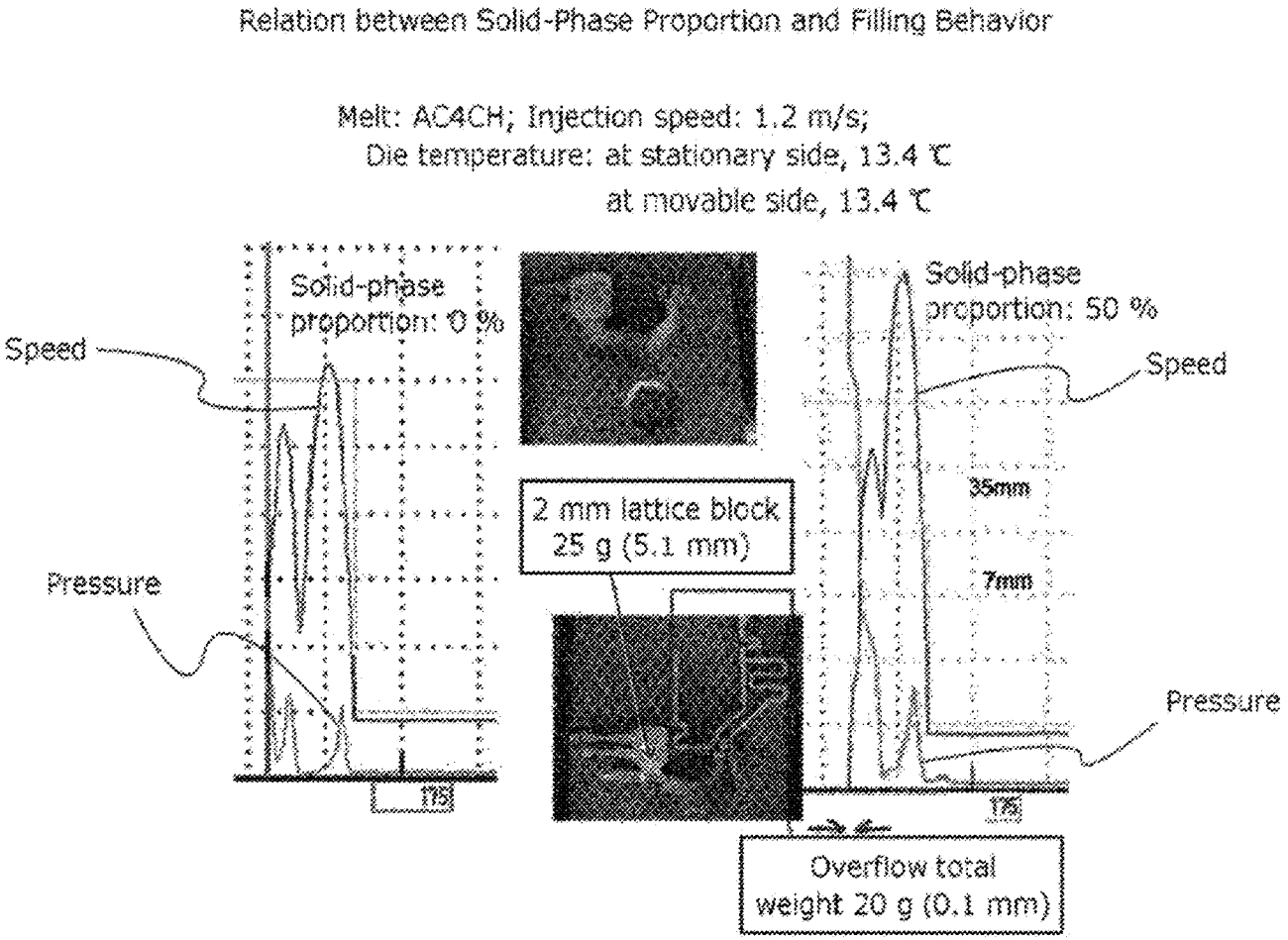
FIG. 6 is a graphical representation showing a relation between a proportion of solid phase and a filling behavior.

Results of the measurement is shown in FIG. 6.

In FIG. 6, a graph shown at the left side is in respect of the comparative example in which the melt at a solid-phase proportion of 0% (in the complete liquid state) is injected under pressure. A graph at the right side is in respect of an embodiment of the invention in which semi-solid one solidified at a proportion of 50% and having a semi-solid structure with particles of a particle size of 30 μm or less is injected under pressure. With the solid-phase proportion of 50%, starting to apply pressure after pouring allows injection to proceed at a constant rate and a casting pressure of zero. When the casting enters inside the die, the rate of advance is accelerated while the pressure is increased. When the die is filled up, the rate reaches a peak whereafter it is decelerated. The rate, however, is not decelerated at a time but with a slope until it reaches zero. This means that as material solidifying shrinks in the die, it still flows into shrinking portions, filling them. Such filling occurs because of a particle size selected to be 30 μm or less. As can be seen from FIG. 6, this phenomenon proceeds continuously until such portions of shrink vanish away. Thus, if a product to be diecast has a portion having a thickness of 0.5 mm or less, the portion can be filled up completely without causing under-filling. Further, since such a portion of shrink is constantly filled up, there is caused no shrinkage cavity or gas entrapment to develop.

Observation of a cross-section of this sample has revealed no gas entrapment and particles as fine as not more than 30 μm in particle size.

On the other hand, with the solid-phase proportion of 0, the rate drops at a time (vertically in the graph). This phenomenon indicates that into a portion of shrink when formed may material not be flowing, leading to the portion of shrink not filled and to a shrinkage cavity.

Embodiment 3

Using a ZDC2 material, a diecast product is made with a particle size of 30 μm or less as in Embodiment 1.

In this embodiment of the invention, results in respect of all of filling property, surface roughness and dimensional precision are superior to those of Embodiment 1.

Comparative Example 2

In this comparative example, ZDC2 is used to replace AC4CH in Comparative Example 1.

There ensue a surface roughness of 3.8 S and a dimensional precision (circularity) of 24/1000 mm, each of which reaches an acceptance criterion.

Also, the filling property is better than in Comparative Example 1. However, a diecast has unfilled portions extant in part and, to be acceptable as a commercial product, need to be finished by surfacing or the like.

Embodiment 4

In this embodiment of the invention, an experiment is performed of varying the filling factor of the melt in the sleeve. The filling factor is varied such as by changing the diameter and length of the sleeve. The melt, immediately after it is poured into the sleeve, is rapidly cooled there and its resulting structure is observed. In this embodiment, the sleeve temperature is 200° C. To wit, making the rate of cooling slower than in Embodiment 1, the experiment is conducted in the state that an influence of the filing factor is more likely to develop.

Different values of the filling factor and resultant particle sizes are examined. The results are shown below.

| | |
|---|---|
| 50% | 80-120 μm |
| 45% | 80-100 μm |
| 40% | 60-100 μm |
| 35% | 50-80 μm |
| 30% | 10-30 μm |
| 25% | 10-30 μm |
| 20% | 10-30 μm |
| 15% | 10-30 μm |
| 10% | 10-30 μm |

Between 30 and 35%, it has been found that particle sizes are remarkably reduced.

And, with a particle size of 30% or less, gas contents are markedly reduced than with those more than that.

Embodiment 5

In this embodiment of the invention, a relation is investigated between a filling factor and a distribution of temperature of the melt poured in the sleeve.

A. Pouring temperature: $T_L$+100° C. (710° C.)
Filling factor: 35%

B. Pouring temperature: $T_L$+(10-40° C.) (620-650° C.)
Filling factor: 35%

C. Pouring temperature: $T_L$+(10-40° C.) (620-650° C.)
Filling factor: 10-30%
(where $T_L$ is a liquidus temperature)

Measurement is made of the temperature of each of points spaced from a tip of the plunger by distances of 136 mm, 256 mm and 376 mm and spaced from the surface of the sleeve by distances of 1 mm, 5 mm and 11 mm, respectively.

Figure 8:
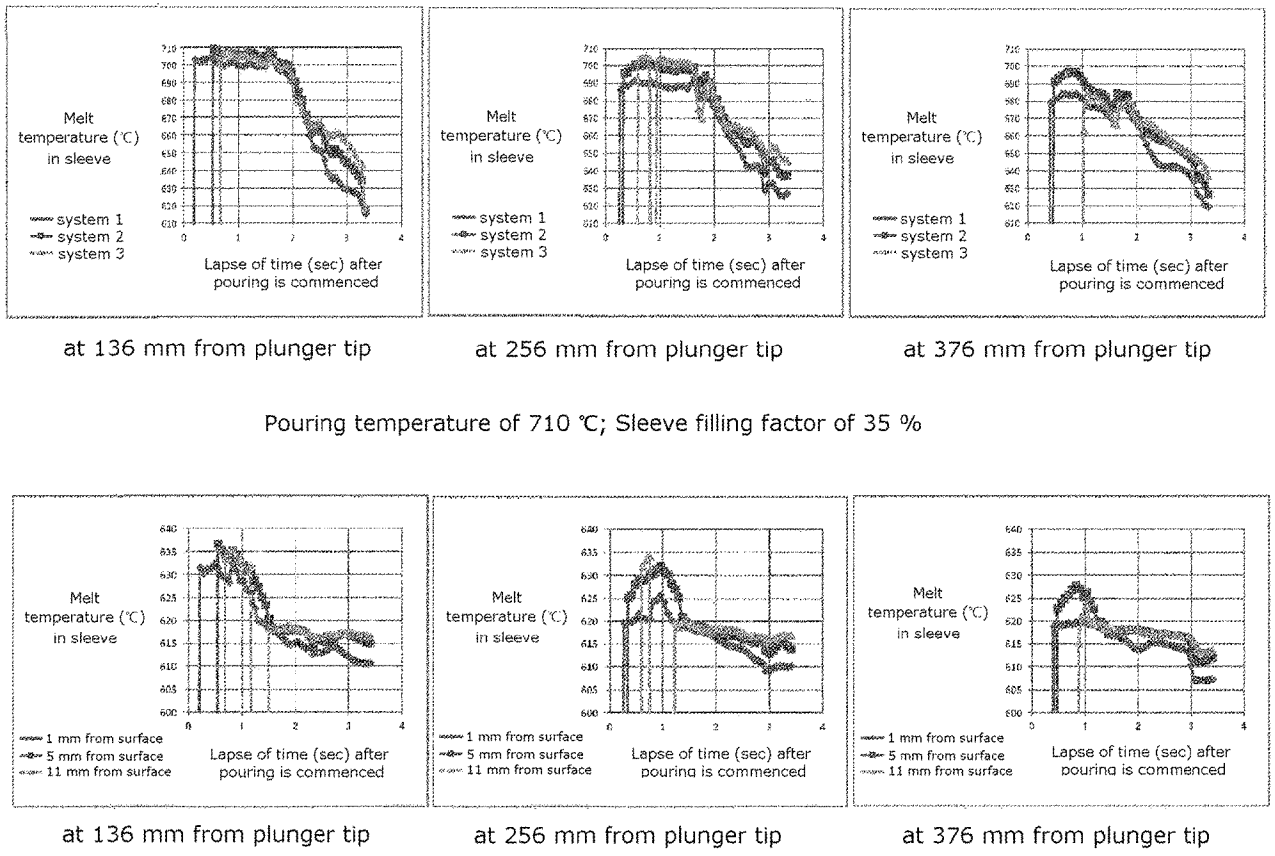
FIG. 8 is a graphical representation showing an influence of a melt temperature and a sleeve filling factor on a temperature in the sleeve.

The results are shown in FIGS. 7 and 8. As for C above, a combination of pouring temperature of 64° C. and filling factor of 18% is representative. A filling factor of 30% is also applicable as is the filling factor of 18%.

From FIGS. 7 and 8, it is seen that at a sleeve filling factor of 35% and at a pouring temperature of 710° C. or 640° C., a melt temperature in the sleeve is that which is in excess of a liquidus temperature. In contrast, under conditions of a sleeve filling factor of not more than 30% and a pouring temperature of 10 to 40° C. above the liquidus temperature, it has been found that in the sleeve a melt temperature is that at which solid and liquid phases coexist and further that in both of a longitudinal direction of the sleeve (direction of advance of the plunger) and a direction of height of the sleeve (directed from the sleeve surface) there can be formed a semi-solid slurry that is essentially homogeneous.

Embodiment 6

Using a prism house die, a melt of AC4CH and a die casting machine of 125 ton under the conditions shown in Table 2 below, casting in this embodiment of the invention is effected with a sleeve filling factor of 10%, 30%, 50% and an injection time lag of 5 seconds.

TABLE 2

| Casting conditions: | |
|---|---|
| Injection speed (low) | 0.2 m/s |
| Injection speed (high) | 1.0 m/s |
| Casting pressure | 60 MPa |
| Sleeve temperature | 190° C. |
| Die (fixed) temperature | 130° C. |
| Die (movable) temperature | 130° C. |
| Melt temperature | 640° C. |

Figure 9:
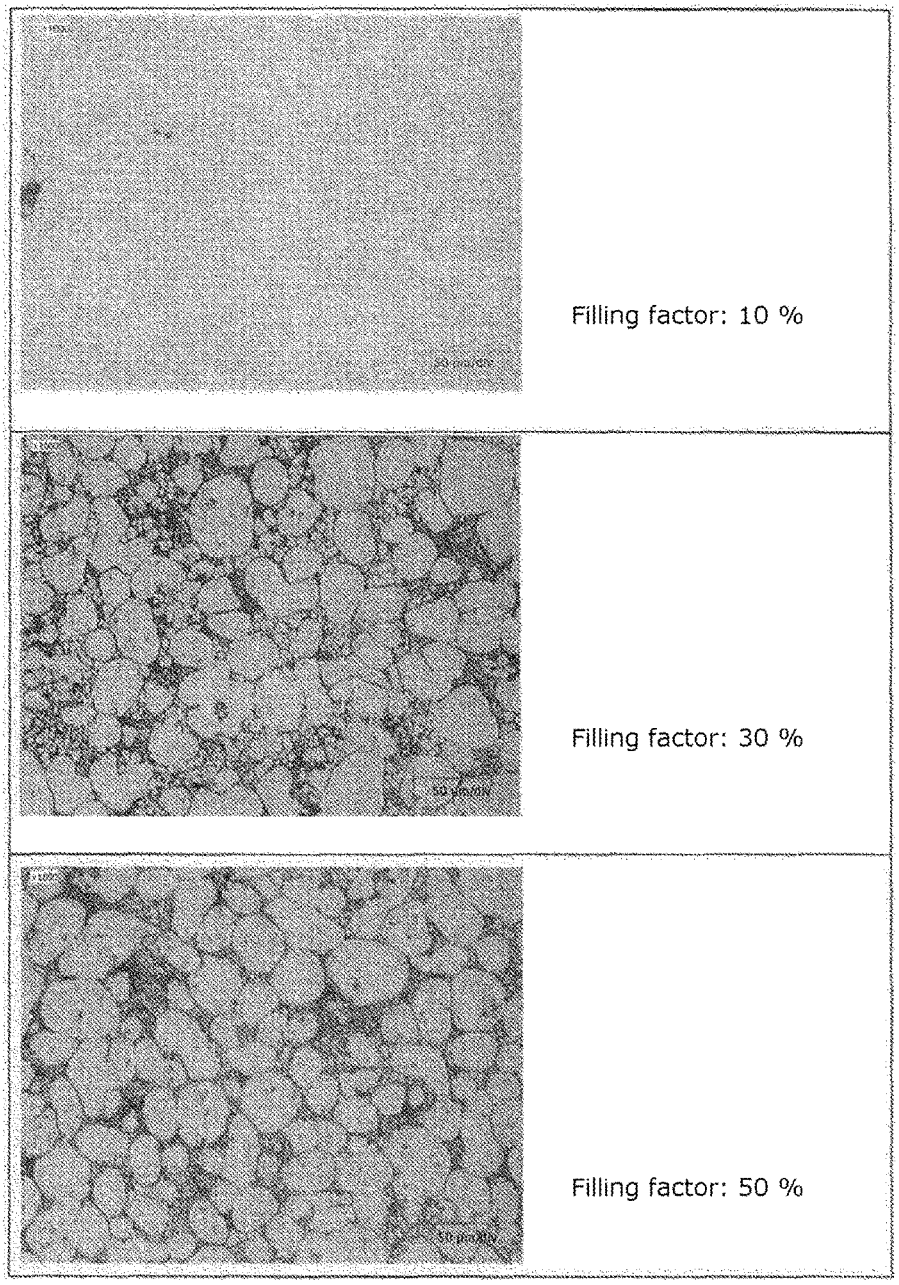
FIG. 9 presents microphotographs showing a relation between a sleeve filling factor and a microfine spheroidal structure.

FIG. 9 shows results of observation of metallographic structure of products from casting in which the sleeve filling factor is varied as 10%, 30% and 50%.

With a filling factor of 50%, large particles having a particle size of 10 to 30 μm are observed entirely over the product.

With a filling factor of 30%, in the product there are observed, together with particles of a particle size of 10 to 30 μm, a large number of particles having a particle size of 2 to 3 μm.

With a filling factor of 10%, particles having a particle size of 10 μm or less are observed entirely over the product. From this structural observation, it has been found that with a filling factor of 30% or less, not only spheroidal crystalline particles of a particle size of 10 to 30 μm but also spheroidal crystalline particles as fine as 2 to 4 μm which has been believed not to develop normally are created in a large number.

Such a structure has been found to be finer than results achieved by the nano cast process and cap process which the present inventors have strived for and the conventional semi-solid casting process.

Figure 10:
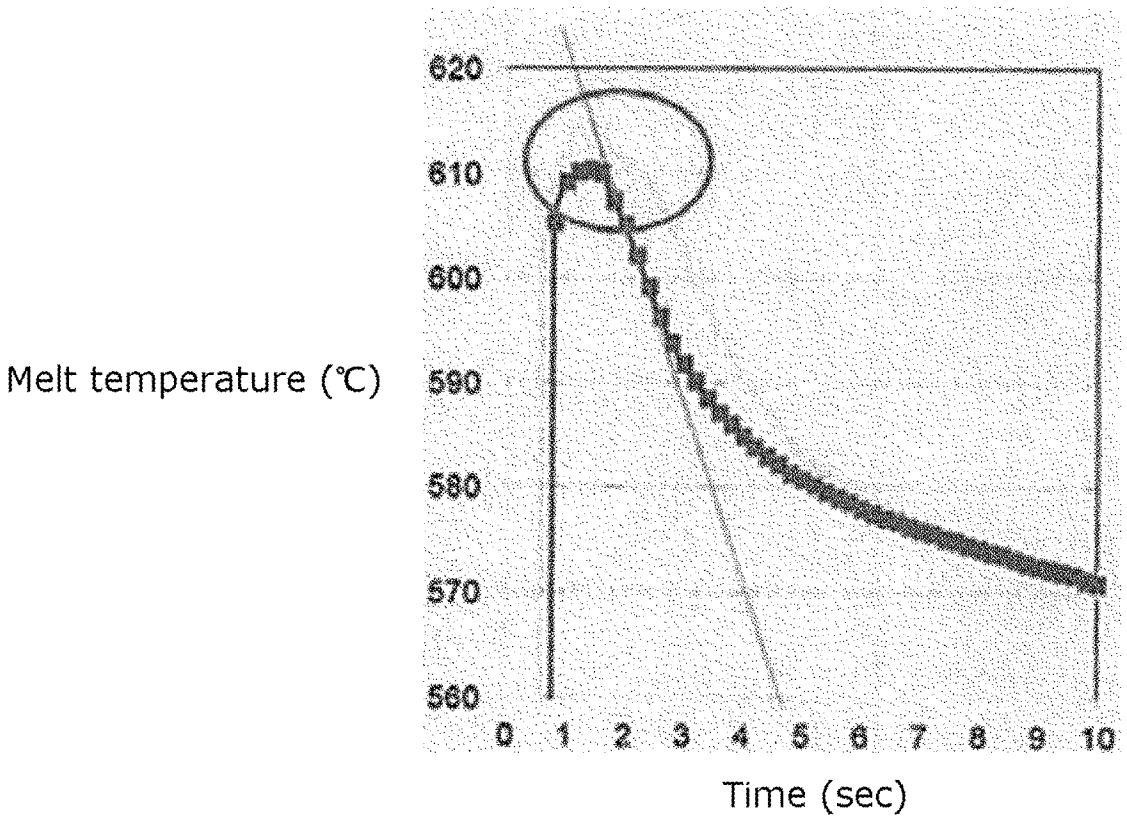
FIG. 10 is a graph showing results of measurement of a melt temperature in a sleeve.

FIG. 10 shows results of measurement of melt temperatures in the sleeve.

Figure 11:
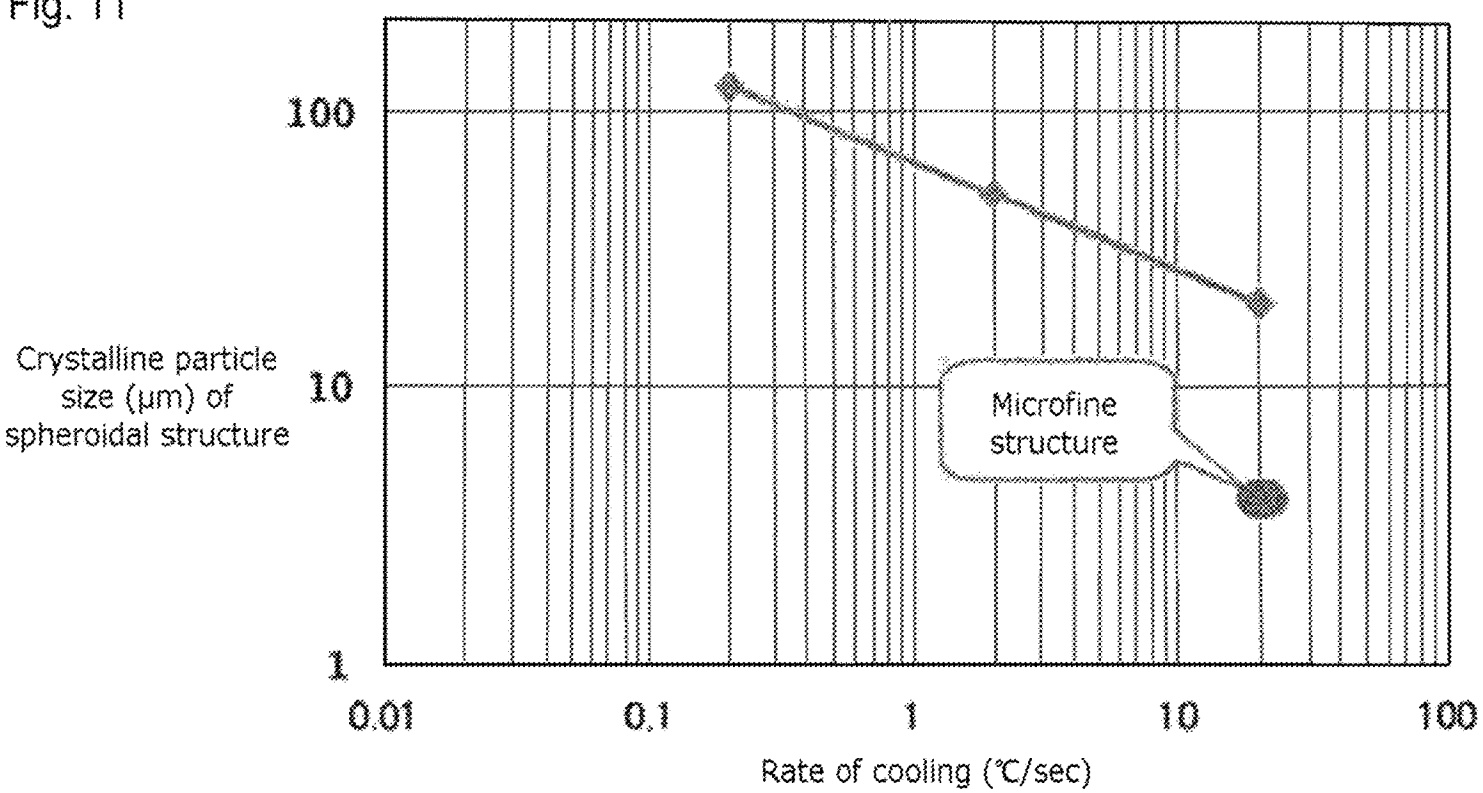
FIG. 11 is a graph showing a relation between a rate of cooling and a crystalline particle size.

In Table 3 there are shown comparisons of a rate of cooling and a particle size in a spheroidal structure between the NRC, nano cast and cup processes. Also, FIG. 11 shows a logarithmic graph of a rate of cooling and a particle size in a spheroidal structure.

From these measurement results it is seen that the rate of cooling at nucleation around the liquidus temperature (inclination of tangent shown in FIG. 10) is 20° C./sec which is much faster than a conventional rate of cooling of 0.2 to 2° C./sec at the formation of a semi-solid slurry in the prior art. According to the conventional rheocasting technique, there has been no report of creation of microfine crystalline particles as achieved here.

A rate of cooling and a particle size of spheroidal structure are met on a line of 1:3. It is shown, however, that the value of 20° C./sec deviates from this line, making the particle size micro-finer.

The occurrence of microfine spheroidal crystalline particles in these tests is considered to be due to having such as a low temperature of casting into the sleeve ($T_L$+50° C. or less where $T_L$ is a liquidus temperature), a limited rate of supply of the melt and a high rate of cooling of the melt in the sleeve (20° C./sec or more), which are considered to create a greater number of crystalline nuclei and in their growth process to cause the adjacent crystallites to restrain each other, forming the microfine spheroidal structure.

TABLE 3

Comparisons of Cooling Rate and Particle Size in Spheroidal Structure between NRC, Nano Cast and Cup Processes

| | Cooling Rate | Particle Size (Normal Structure) | Particle Size Microfine Structure |
|---|---|---|---|
| NRC Process | 0.2° C./sec | 100-150 μm (125 μm) | — |
| Nano Cast Process | 2° C./sec | 30-70 μm (50 μm) | — |
| Cup Process | 2° C./sec | 30-70 μm (50 μm) | — |
| Sleeve Process | 20° C./sec | 10-30 μm (20 μm) | ≤10 μm (mean 4 μm) |

Embodiment 7

This embodiment of the invention is carried out identically to Embodiment 1 except for a filling factor of 40%, a sleeve width of 0.6 D where D is an inner diameter of the sleeve, a sleeve temperature held at 100° C. and a melt temperature of 640° C.

In this embodiment as well, particles are obtained having a particle size of 30 μm or less, making it possible to fill a portion of a thickness of 0.4 mm or less.

Embodiment 8

In this embodiment of the invention, the die in Embodiment 1 is replaced to cast parts each in the form of a plate.

The parts cast are of simply flat plates of thicknesses of 0.6 mm, 0.5 mm, 0.4 mm, 0.3 mm, 0.2 mm and 0.1 mm and of a flat plate having a thickness of 0.4 mm and formed with a diaphragm having a thickness of 0.1 mm. In each casting, a shot time lag of 3 seconds is selected.

Each of these parts has been cast without underfill or leaving any unfilled portion.

Embodiment 9

In this embodiment of the invention, the proportion of solid phase is varied.

It is varied in every 10% between 10 and 80%.

One with a solid-phase proportion of 50% or more is higher in degree of filling up into a thinner portion than with a solid-phase proportion of less than 50%.

Embodiment 10

In this embodiment of the invention, an influence is investigated of a lapse of time up to injection from pouring into the sleeve (shot time lag).

Using a die casting machine of 125 tons and under conditions shown in Table 4, casting is effected with an injection time lag of 0 second, 3 seconds, 5 seconds.

TABLE 4

| Casting Conditions | |
|---|---|
| Injection speed (low) | 0.2 m/s |
| Injection speed (high) | L 0 m/s |
| Casting pressure | 60 MPa |
| Die (fixed) temperature | 250° C. |
| Die (movable) temperature | 250° C. |
| Temperature of melt (AC4CH) | 650° C. |
| Sleeve filling factor | 25% |

FIG. 12 shows a Relation Between an Injection Time Lag and a microfine spheroidal structure with a sleeve filling factor of 25%.

Figure 13:
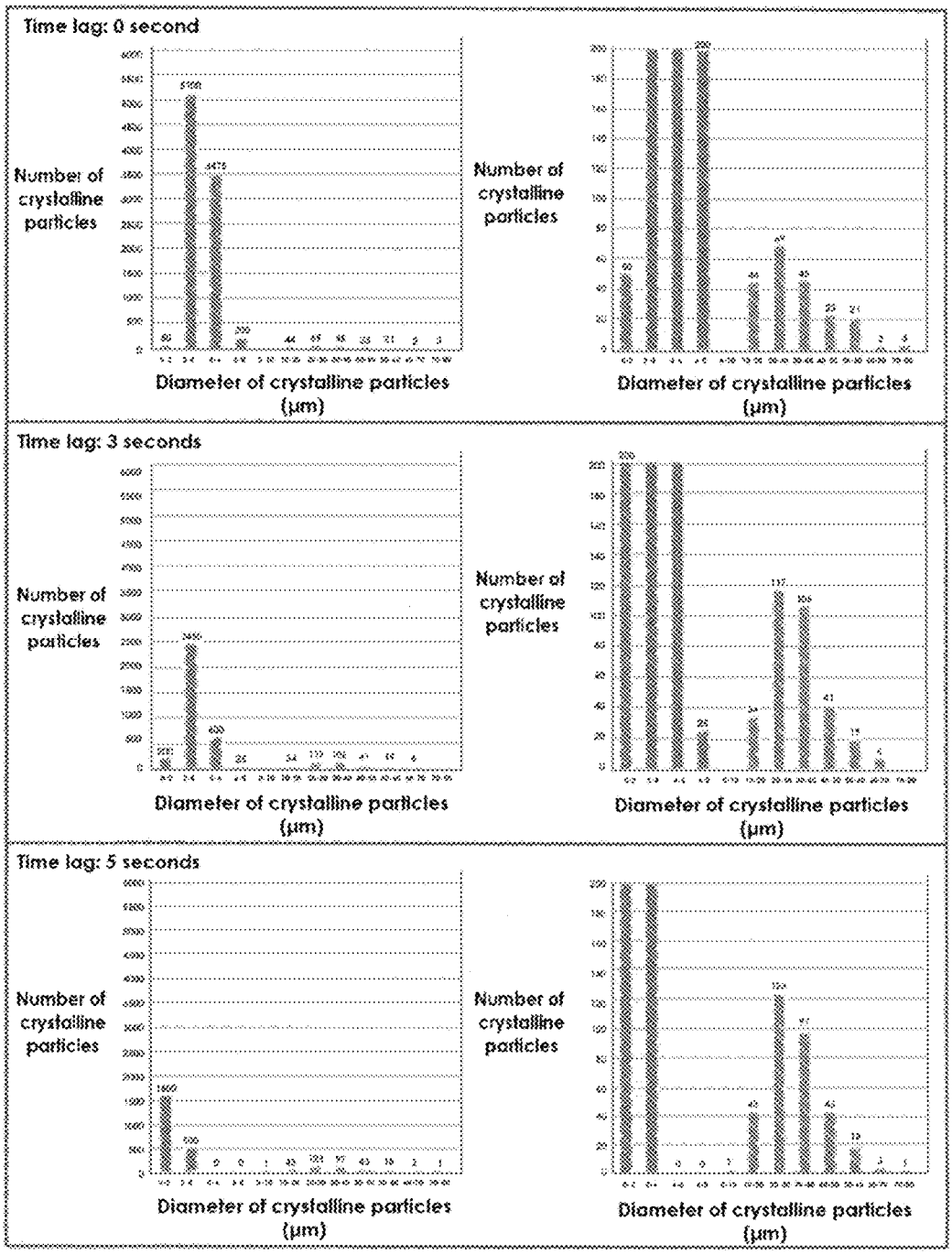
FIG. 13 is a graphical representation showing a relation between an injection time lag and a crystalline particle size.

FIG. 13 shows results of measurement, and finding a distribution, of particle sizes of spheroidal crystalline particles by casting with each of these injection time lags.

From such distributions, it has been found here, too, that not only microfine spheroidal crystalline particles having a particle size of 10 to 30 μm but also spheroidal crystalline particles as much finer as 3 μm in particle size which are not conventionally formed are created in large number.

From results of measurement of melt temperatures in the sleeve, it is seen that the rate of cooling for nucleation around the liquidus temperature is 20° C./sec that is much faster than the rate of cooling of 0.2 to 2° C./sec at which a conventional semi-solid slurry is formed. Using the conventional rheocasting technique, there has been no report of having created spheroidal crystalline particles as microfine as 3 μm as achieved here.

As the shot time lag is longer, microfine spheroidal structures that fill up spaces between primary aluminum crystals when it is 0 second are reduced, and when it is 5 seconds, are observed among primary crystals in eutectic structure normally seen of a size of 10 to 30 μm. It has not yet been fully clarified what specific history, while a melt of material is poured into the sleeve and the material in the sleeve is injected and molded, is followed in forming and further micronizing such a spheroidal structure. It is noted, however, that incomparably with a time consumed to form, inject and solidify a conventional semi-solid slurry, the rate of cooling after pouring is here fast, as high as 20° C. It. Therefore, the rate of passage immediately above and below the melting point is fast as well. This is presumed to facilitate nucleation to an extent that has not hitherto been confirmed and to permit control extinction and reduction of the crystal nuclei that have occurred for injection while solidification. These are conjectured to explain that post-micronized spheroidal structures are recognized.

While the time lag is extended further, i.e. to exceed 5 seconds, a large number of the crystal nuclei that has been extant become extinct. Thus, in a time period up to immediately before injection, spheroidal crystals appear to have grown in the sleeve. It is deemed that a microfine spheroidal structure is then not formed.

INDUSTRIAL APPLICABILITY

The present invention can widely be utilized in a variety of fields such as electric, electronic, automobile and fuel cell and other industries where thin parts are needed.

Without requiring an exclusive slurry forming equipment unit needed conventionally, an unconventional structure with micro-finer particles is formed in accordance with the invention directly in a sleeve of the conventional die casting machine. Effecting optimum control of a melt temperature and others in the sleeve makes it possible to facilitate nucleation and forming microfine spheroidal crystalline particles in the sleeve whereby a microfine semi-solid slurry can be formed inexpensively, quickly and easily.

Made by the unique sleeve method of the invention, an aluminum semi-solid cast product (AC4CH) yields better results in surface roughness precision and dimensional accuracy than a zinc cast product (ZDC2), making a material substitution possible. The method is henceforth expected to be exploited for weight saving of automobile parts and in production of precision components.

What is claimed is:

1. A diecast product of an hypo-eutectic aluminum alloy, comprising:

non-dendritic spheroidal primary alpha-aluminum crystals that have sizes 10 μm-30 μm, and microfine spheroidal crystalline (aluminum) particles that have sizes 2 μm-4 μm situated among said non-dendritic spheroidal primary aluminum crystals.

2. The diecast product according to claim 1, wherein, as cast, the diecast product has a portion having a thickness of 0.5 mm or less.

3. The diecast product according to claim 1, wherein, as cast, the diecast product has a portion having a thickness of 0.1 mm or less.

4. The diecast product according to claim 1, wherein the alloy is an aluminum alloy of Al—Si system, Al—Si—Mg system, Al—Si—Cu system, or Al—Mg system.

5. The diecast product according to claim 1, wherein the diecast product contains an internal gas at a content 1 cc/100 g or less under an environment of ordinary temperature and pressure.

6. The diecast product according to claim 1, wherein said alloy is AC4CH, which is composed of Cu: less than 0.10
Si: 6.5-7.5
Mg: 0.25-0.45
Zn: less than 0.10
Fe: less than 0.20
Mn: less than 0.10
Ni: less than 0.05
Ti: less than 0.20
Pb: less than 0.05
Sn: less than 0.05
Cr: less than 0.05
Al: bal.

* * * * *